US005213557A

United States Patent [19]

Firth

[11] Patent Number: 5,213,557

[45] Date of Patent: May 25, 1993

[54] DEVICE FOR EXERCISING PELVIC FLOOR MUSCLES

[76] Inventor: John Firth, Orchard House, 19, Birmingham Rd., Blakedown, Kidderminster, DY10 3JD, England

[21] Appl. No.: 771,815

[22] Filed: Oct. 7, 1991

Related U.S. Application Data

[63] Continuation of Ser. No. 509,049, Apr. 13, 1990, abandoned.

[30] Foreign Application Priority Data

Apr. 14, 1989 [GB] United Kingdom ..... 8908449

[51] Int. Cl.[5] ..... A63B 21/065

[52] U.S. Cl. ..... 482/105; 482/93

[58] Field of Search ..... 272/116, 119, 93, 117, 272/120, 137; 600/28, 32; 482/93, 105, 107, 148

[56] References Cited

U.S. PATENT DOCUMENTS

| | | | |
|---|---|---|---|
| 4,384,714 | 5/1983 | Kimura | 272/119 |
| 4,431,185 | 2/1984 | Cisneros | 272/119 |
| 4,574,791 | 3/1986 | Mitchener | 272/137 |
| 4,895,363 | 1/1990 | Plevnik et al. | 272/93 |

FOREIGN PATENT DOCUMENTS

| | | | |
|---|---|---|---|
| 0088173 | 9/1982 | European Pat. Off. . | |
| 0198641 | 10/1986 | European Pat. Off. . | |
| 2121790 | 11/1972 | Fed. Rep. of Germany . | |
| 336941 | 4/1959 | Switzerland . | |
| 2058571 | 4/1981 | United Kingdom | 272/93 |

*Primary Examiner*—Stephen R. Crow

*Attorney, Agent, or Firm*—Renner, Kenner, Greive, Bobak, Taylor & Weber

[57] ABSTRACT

A device for exercising pelvic floor muscles by insertion into the vagina of a woman comprises at least one weight, and a casing with two or more parts releasably and sealingly connected, to define an internal cavity for receiving one or more of the weights. The cavity is preferably of plastics material, the parts having a snap fit connection, and a retrieval tag may also be incorporated. A set of weights is preferably provided, so that the mass of the device can be varied by choosing one or more of the weights.

18 Claims, 1 Drawing Sheet

DEVICE FOR EXERCISING PELVIC FLOOR MUSCLES

This is a continuation of application Ser. No. 509,049 filed Apr. 13, 1990, now abandoned.

This invention relates to a device for exercising pelvic floor muscles.

Without exercise, pelvic floor muscles tend to weaken with age, giving rise to problems with bladder control. In women, this weakening is often exacerbated by childbirth. However, many women have no conscious control of these muscles, and find it very difficult to exercise them properly, in order to strengthen them, without assistance.

One known way of providing assistance is by means of a biofeedback perineometer, comprising a vaginal probe connected to an external unit which provides information about changes in vaginal pressure. This encourages conscious control of the pelvic floor muscles. However, this device is not very pleasant to use, and requires regular attendance at a hospital or clinic as an outpatient. Another known way of assisting in the exercise of the pelvic floor muscles involves the use of a set of devices of identical size but differing mass, and is shown in EP-A-0 198 641. One device is inserted into the vagina, where it can be retained by using the pelvic floor muscles, thus exercising them. Such a device also operates on a feedback principle, as any tendency for it to slip out makes the pelvic floor muscles contract to try to retain it. The device can readily be used at home and is also much pleasanter and easier to use than the perineometer, although frequent attendance to a hospital or clinic will still be required, for the mass to be changed as the muscles strengthen. The main disadvantage of these devices is that they are expensive. Each device is made in two parts, one in brass and one in polymethylacrylate, the mass being varied by changing the proportion of the materials. The two parts must be bonded together, and the brass part coated with a physiologically acceptable material, so that a set of up to nine devices is expensive to produce. Because of the expense, it is unlikely that a woman will be given an unused device each time, and this may well not be acceptable to her, even though the device will have been sterilised.

According to the present invention, a device for exercising pelvic floor muscles by insertion into the vagina, comprises at least one weight and a casing having at least two parts adapted to be releasably and sealingly connected together, with an internal cavity for receiving one or more of the weights.

Providing a single casing and a separate weight or weights reduces the cost of producing the device, especially as it is only one item, the casing, which need be physiologically acceptable. It then becomes feasible to provide an unused casing for each woman, although the weights may be re-used if necessary.

A set of two or more weights may be provided. It is then possible to provide the woman with an appropriate set of weights which enables her to vary the mass of the device herself, as the muscles strengthen. This results in better monitoring of her progress by the woman, and less frequent visits to the hospital or clinic.

Preferably the casing is of plastics material. Conveniently, two casing parts are provided to define the internal cavity, with their external outline shaped to allow ease of use. The parts may be a snap fit. A first part (the lower part in use) is preferably substantially conical, with a rounded tip. The casing may also incorporate a retrieval tag. This may be a separate item, releasably and sealingly connected to the first casing part, or it may be formed integrally with that part. A second part (the upper part in use) may be cylindrical, frusto-conical or even part-spherical.

Where a single weight is used it may have a shape complementary to that of the internal cavity, and where a set is provided the whole set fits together to form a similar complementary shape. The weights of a set are preferably of different masses, so that the mass of the device can be varied by choosing one or more weights. Preferably the set of weights includes a rod onto which the other weights fit.

Some embodiments of the invention are illustrated, by way of example, in the accompanying drawings, in which.

Figure 1:
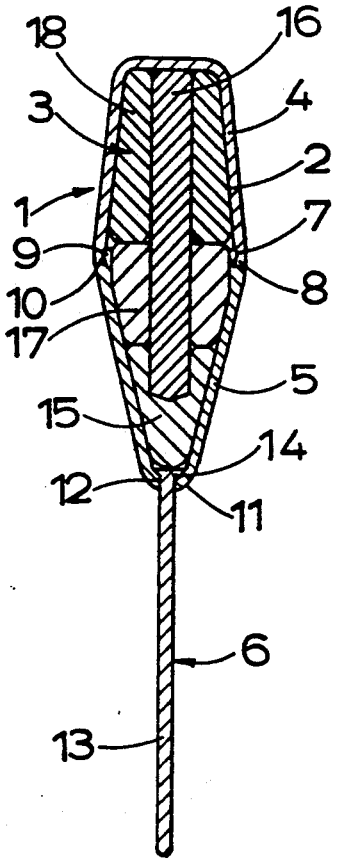
FIG. 1 shows a cross-section through a device for exercising pelvic floor muscles.
Figure 2:
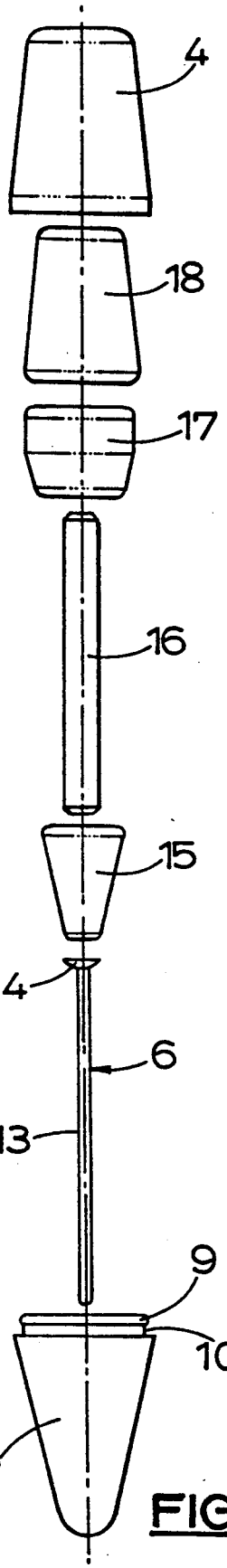
FIG. 2 is an exploded view of the device of FIG. 1.

The device shown in FIGS. 1 and 2 is adapted to be inserted into the vagina of a woman to exercise the pelvic floor muscles. It comprises a multi-part casing 1 with an internal cavity 2 for receiving one or more weights, in this case a set of weights 3, so that the mass of the device can be varied.

The casing 1 is of a physiologically acceptable plastics material, and is shaped for ease of use. It has three parts 4,5,6 which are releasably and sealingly connected together. The parts 4,5 define the internal cavity 2. The upper part 4 is hollow and of frusto-conical outline, being closed at one end. As its opposite open end it has a groove 7 and projection 8 adapted to engage with a respective projection 9 and groove 10 on an open end of the lower part 5. The two parts 4,5 snap together. The lower part 5 is hollow and substantially conical in outline, with a rounded tip 11 opposite the open end. The tip 11 has an aperture 12 which receives the third part 6, which comprises a retrieval tag. The tag 6 has an elongate tail portion 13, and is retained in the lower part 5 by a part-spherical abutment 14, which engages sealingly with the aperture 12.

The set of weights 3 has four brass components, 15,16,17 and 18, which fit together to form a shape corresponding to that of the internal cavity 2. The weight 15 is substantially conical, to fit into the tip 11 of the lower part 5, and has a recess 19 which is adapted to receive part of the component 16, which is a cylindrical rod. The weights 17 and 18 are substantially annular, and fit over the rod 16. The components have different masses, so that one or more of the components can be selected to provide a given mass.

Before use, the casing 1 and weights 3 are sterilised. The tag 6 is then assembled into the lower part 5, an appropriate selection from the set of the weights 3 is made and inserted into the cavity 2, and the upper and lower parts 4,5 are fitted together. The device is then inserted into the vagina of a subject, upper part first. The pelvic floor muscles are exercised by attempting to retain it. The device will normally be left in place for a given length of time, perhaps 10 to 15 minutes, and is then removed by means of the tag 6.

It will usually be necessary for each subject to determine by experiment the appropriate mass which provides the necessary exercise for strengthening the muscles. Normally, up to a certain mass, the device can be retained without any conscious control of the pelvic floor muscles, but for heavier masses conscious control is required. The appropriate mass will usually be the lightest one to require this conscious control. It has been found that, when the device has the appropriate mass, it tends to slip out, and this sensation provides a biofeedback which makes the pelvic floor muscles contract to try to retain it. As the muscles strengthen, heavier masses can be retained.

Once the appropriate mass has been determined initially, the device is used regularly, preferably each day, at home by the subject. The subject can increase the mass herself as the muscles strengthen, simply by snapping the upper and lower parts 4,5 apart, inserting a different selection of weights, and then fitting the parts 4,5 together again. This means that the subject can monitor her progress herself, without needing frequent visits to a hospital or clinic.

Figure 3:
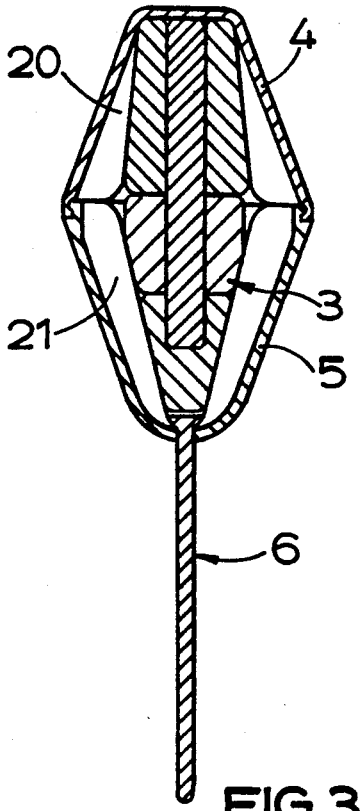
FIGS. 3 and 4 are similar to FIG. 1, but show modifications.
Figure 4:
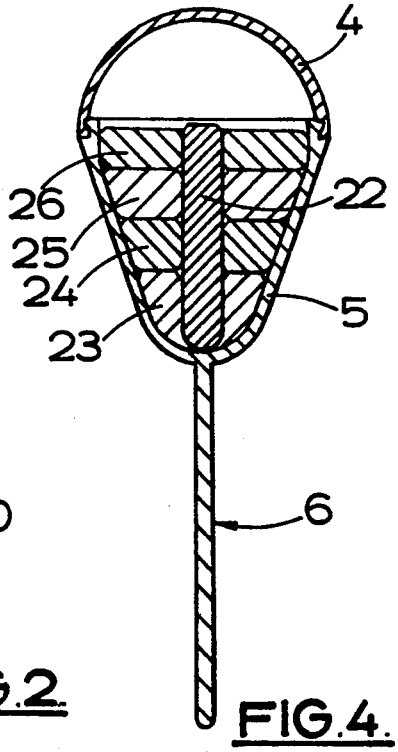
Figure 5:
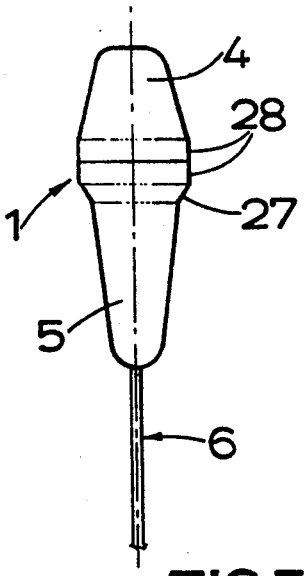
FIG. 5 is a side view of a further modification.

FIGS. 3 to 5 show modifications of the device, in which the shape of the casing 1 is varied in order to suit different subjects. Other variations are of course possible. In FIG. 3 the casing 1 has a larger maximum diameter, but uses the same set of weights 3 as in FIG. 1. In FIG. 3, the upper and lower parts 4,5 are provided with internal ribs 20,21 respectively, with which the weights engage. In a modification, not shown, different sets of weights could be used, with the ribs 20,21 being modified or omitted accordingly.

In FIG. 4 the casing 1 and the weights 3 are modified. The lower part 5 of the casing is the same shape as that of FIG. 3, but the retrieval tag 6 is formed integrally with the part 5. The upper part 4 is hemi-spherical. There are five components in the set of weights 3, which has a rod 22 onto which fits all the other components (23 to 26) which are of frusto-conical or cylindrical outline.

In FIG. 5 yet another shape of casing 1 is shown, in which the lower part 5 has a shoulder 27, and there is a cylindrical portion 28 on each part adjacent its open end.

Further modifications, not shown, may be made to the casing 1. In particular, different forms of the connection between the parts 4,5 may be used; for example a screw-threaded connection may be provided.

In yet another modification, not shown, the set of weights has fewer or more parts, and may not include the central rod. In an alternative version, not shown, a single weight is used. The shape of the single weight, or of the set, need not be complementary to the internal cavity. The weights may also be of other materials, for example stainless steel, instead of brass.

What is claimed is:

1. A device for exercising pelvic floor muscles by inserting into the vagina, said device comprising a casing being a vaginal insert, and a set of two or more weights separate from said casing, said casing having at least two parts and means defining an internal cavity in said casing for removably receiving one or more of said weights, wherein said casing parts have a sealing connection therebetween, said connection being releasble to allow access to said cavity for insertion of at least one said wight, and said connection being made to seal said casing, said casing and said connection being so constructed that when said casing is sealed it supports and retains said weights in said cavity, said weights fitting together to form a shape complementary to at least a portion of said internal cavity, and said casing parts in which said cavity is defined being adapted to be fully received in the vagina.

2. A device as claimed in claim 1, wherein said casing is of plastics material.

3. A device as claimed in claim 1, wherein said casing has first and second parts defining said internal cavity.

4. A device as claimed in claim 1, wherein said casing parts have a snap fit connection.

5. A device as claimed in claim 1, wherein said casing has a first casing part, the lower part in use, which is substantially conical, with a rounded tip.

6. A device as claimed in claim 1 wherein said casing has a second casing part, the upper part in use, which is cylindrical.

7. A device as claimed in claim 1, wherein said casing incorporates a retrieval tag.

8. A device as claimed in claim 7, wherein said retrieval tag is releasably and sealingly connected to a first part of said casing, being a lower part in use.

9. A device as claimed in claim 7, wherein said retrieval tag is formed integrally with a first part of said casing, being a lower part in use.

10. A device as claimed in claim. 1, wherein a set of two or more weights is provided.

11. A device as claimed in claim 10, wherein said weights of a set are of different masses.

12. A device as claimed in claim 1, wherein a single weight is provided, said weight having a shape complementary to that of said internal cavity.

13. A device as claimed in claim 10, wherein said set of weights includes a rod onto which said other weight or weights fit.

14. A device as claimed in claim 1, wherein said casing has a second casing part, the upper part in use, which is frusto-conical.

15. A device as claimed in claim 1 wherein said casing has a second casing part, the upper part in use, which is part-spherical.

16. A vaginal insert for exercising pelvic floor muscles by insertion of a device into the vagina, said device comprising a casing and a set of weights separate from said casing, said casing having at least two parts adapted to ge releasably and sealing connected together, and means defining an internal cavity in said casing fior removably receiving one or more of said weights, wherein said two casing parts are relatively movable by the user between an open configuration and a closed configuration, access to said cavity being afforded when said two casings parts are placed in said open configuration whereby said at least one weight is introducible into said cavity by said user, and wherein when said two casing parts are placed in said closed configuration by said user said two casing parts engage each other and at least one said weight is held in said cavity, said weights fitting together to form a shape complementary to at least a portion of said internal cavity.

17. A device as claimed in claim 16, wherein said two parts form a housing in said closed configuration which substantially completely encloses said weight.

18. A kit of parts for exercising pelvic floor muscles by inserting a device into the vagina, said kit comprising a device having a casing for insertion into the vagina, and a set of weights separate from aid casing said casing having at least two parts and means defining an internal cavity in said casing, said parts having a sealing connection therebetween, said connection being releasble to allow access to said cavity and being made to seal said casing again, each of said set of weights being insertable into said cavity at the choice of the user when said two parts are in said released condition, wherein the weight of said device is variable at the discretion of the user by the choice and insertion by the user of a selected said weight or combination of said weights of said set into said cavity to suit the user's needs said casing with said weights inserted comprising a device which is fully inserted into the vagina and wherein said weights fit together to form a shape complementary to at least a portion of said internal cavity.

* * * * *